US009863629B2

(12) United States Patent
Doyle

(10) Patent No.: US 9,863,629 B2
(45) Date of Patent: Jan. 9, 2018

(54) PENDANT OR ACCENT LIGHT WITH THERMAL EXPANSION ACCOMMODATION HEAT SINK

(75) Inventor: Kevin Doyle, Delray Beach, FL (US)

(73) Assignee: Pentair Water Pool and Spa, Inc., Cary, NC (US)

( * ) Notice: Subject to any disclaimer, the term of this patent is extended or adjusted under 35 U.S.C. 154(b) by 110 days.

(21) Appl. No.: 13/206,499

(22) Filed: Aug. 9, 2011

(65) Prior Publication Data

US 2013/0039043 A1 Feb. 14, 2013

(51) Int. Cl.

| | |
|---|---|
| ***F21L 4/00*** | (2006.01) |
| ***F21V 25/00*** | (2006.01) |
| ***F21V 31/00*** | (2006.01) |
| ***F21V 29/56*** | (2015.01) |
| ***F21V 29/507*** | (2015.01) |
| ***F21V 29/89*** | (2015.01) |
| ***F21V 29/87*** | (2015.01) |
| ***F21V 23/00*** | (2015.01) |
| ***F21V 29/00*** | (2015.01) |
| *F21W 131/401* | (2006.01) |
| *F21Y 115/10* | (2016.01) |

(52) U.S. Cl.

CPC ..... *F21V 31/005* (2013.01); *F21V 23/006* (2013.01); *F21V 29/20* (2013.01); *F21V 29/507* (2015.01); *F21V 29/56* (2015.01); *F21V 29/87* (2015.01); *F21V 29/89* (2015.01); *F21W 2131/401* (2013.01); *F21Y 2115/10* (2016.08); *Y10T 29/49002* (2015.01)

(58) Field of Classification Search

CPC ..... F21V 23/006; F21V 29/20; F21V 31/005; F21W 2131/401; F21Y 2101/02

USPC ..... 362/158, 101, 264, 267, 373, 294

See application file for complete search history.

(56) References Cited

U.S. PATENT DOCUMENTS

| | | | | |
|---|---|---|---|---|
| 6,583,980 | B1 * | 6/2003 | Wang | H01L 21/6831 361/233 |
| 7,048,410 | B2 * | 5/2006 | Kutler | F21V 29/83 362/218 |
| 7,083,305 | B2 * | 8/2006 | Galli | 362/294 |
| 7,168,825 | B2 * | 1/2007 | McArthur | 362/267 |
| 7,244,037 | B2 | 7/2007 | Koren et al. | |

(Continued)

*Primary Examiner* — Tsion Tumebo

(74) *Attorney, Agent, or Firm* — Quarles & Brady LLP

(57) ABSTRACT

An underwater pendant or accent light in contact with a body of water is provided. The underwater pendant or accent light has a housing. The housing has an at least one water tight end fitting at a first end of the housing and an at least one lens at a second end of the housing. An electronics section is further provided. The electronics section including an at least one controller contained within the housing and coupled to a power source. An at least one LED is coupled to the electronics section. An at least one heat sink is coupled to the at least one LED and the electronics section, the heat sink thermally coupled to and mounting the at least one LED and thermally coupled to the electronics section such that heat is communicated through the at least one heat sink. The heat sink has an at least one thermal expansion slot to accommodate thermal expansion of the heat sink as it absorbs heat, wherein the heat sink is in thermal communication through a thermal path with the housing and transmits the absorbed heat through the housing and lens to the body of water. A method of using same is also provided.

19 Claims, 4 Drawing Sheets

(56) References Cited

U.S. PATENT DOCUMENTS

| | | | | |
|---|---|---|---|---|
| 7,303,301 | B2 | 12/2007 | Koren et al. | |
| 7,327,930 | B2 | 2/2008 | Koren et al. | |
| 7,367,686 | B2 * | 5/2008 | Rohlfing et al. | 362/240 |
| 7,410,268 | B2 | 8/2008 | Koren et al. | |
| D590,075 | S | 4/2009 | Grajcar | |
| D590,076 | S | 4/2009 | Grajcar | |
| D590,077 | S | 4/2009 | Grajcar | |
| 7,553,039 | B2 | 6/2009 | Harris et al. | |
| D600,837 | S | 9/2009 | Grajcar | |
| D601,276 | S | 9/2009 | Grajcar | |
| D601,277 | S | 9/2009 | Grajcar | |
| 7,598,682 | B2 | 10/2009 | Grajcar | |
| D610,723 | S | 2/2010 | Grajcar | |
| 7,699,515 | B2 | 4/2010 | Faber et al. | |
| 7,740,367 | B2 | 6/2010 | Koren et al. | |
| 7,910,943 | B2 | 3/2011 | Kim et al. | |
| 7,911,797 | B2 | 3/2011 | Grajcar | |
| 7,938,567 | B2 | 5/2011 | Faber et al. | |
| 7,960,921 | B2 | 6/2011 | Grajcar | |
| 8,033,677 | B1 * | 10/2011 | Olsson et al. | 362/101 |
| 8,172,434 | B1 * | 5/2012 | Olsson | B63B 45/00 362/241 |
| 8,760,042 | B2 * | 6/2014 | Sakai et al. | 313/46 |
| 8,773,007 | B2 * | 7/2014 | Van De Ven et al. | 313/318.01 |
| 2004/0120156 | A1 * | 6/2004 | Ryan | 362/373 |
| 2009/0296414 | A1 * | 12/2009 | Moriyama | F21S 8/026 362/373 |
| 2010/0246178 | A1 * | 9/2010 | Giardina et al. | 362/249.02 |
| 2012/0230034 | A1 * | 9/2012 | Boomgaarden | F21V 3/02 362/294 |

* cited by examiner

PENDANT OR ACCENT LIGHT WITH THERMAL EXPANSION ACCOMMODATION HEAT SINK

BACKGROUND OF THE INVENTION

Field of the Invention

The invention relates to a LED underwater pool light, more specifically an exemplary embodiment of an underwater LED light known as a pendant or accent light in the industry.

Background of the Invention

Existing LED underwater pendant or accent lights have known reliability issues in remaining water tight. One example of an existing pendant light is the light produced by Nexxus Lighting and sold as the SAVI-MELODY LED light. There have been a number of issues in these popular existing designs with leaks and warranty claims based on broken seals. In existing LED lights, expansion from heat generated by the LEDs and the electronics often causes unacceptable expansion pressures on the seals and the housing of the accent or pendant light. This results in eventual fatigue and failure in the soundness of the housing. Besides rendering the LED non-functional and causing warranty claims issues, water infiltration also poses potential safety issues in submerged lighting. Thus a need exists for an improved LED pendant or accent light that does not exhibit the debilitating issues with transmitted thermal expansion pressures and failure of the watertight housing. The instant invention provides for an improved light that is more reliable and has better thermal energy transport away from the thermal sources.

SUMMARY OF THE INVENTION

An object of the invention is to provide a more efficient heat sink that accommodates thermal expansion and reduces pressure on water tight seals in an underwater LED pendant or accent light.

A further object of the invention is to provide a further thermally conductive cooling path in an underwater LED pendant or accent light that allows heat to radiate from the heat sink into the body of water through a thermal pathway provided in the underwater LED pendant or accent light.

The invention includes an article of manufacture, an apparatus, a method for making the article, and a method for using the article.

The method of the invention includes a method of using a heat sink in a submerged accent light to provide reduced pressure on the water tight light housing, having the steps of assembling a water tight accent or pendant light having a lens, a coupling to a power source, an electrical section, an at least one LED, and the heat sink assembled and contained in the housing; providing an at least one thermal expansion slot in the heat sink and a thermal conductive path from the heat sink to the housing and lens such that the thermal expansion slot permits thermal expansion of the heat sink as it absorbs heat from the at least one LED and the electronics section; and installing and cooling the submerged accent light in an installation in a body of water through the thermal conductive path.

The apparatus of the invention includes an underwater pendant or accent light in contact with a body of water. The apparatus having a housing with an at least one water tight end fitting at a first end of the housing and an at least one lens at a second end of the housing. An electronics section including an at least one controller contained within the housing and coupled to a power source. An at least one LED is coupled to the electronics section. An at least one heat sink is coupled to the at least one LED and the electronics section, the heat sink thermally coupled to and mounting the at least one LED and thermally coupled to the electronics section such that heat is communicated through the at least one heat sink, the heat sink having an at least one thermal expansion slot to accommodate thermal expansion of the heat sink as it absorbs heat, wherein the heat sink is in thermal communication through a thermal path with the housing and transmits the absorbed heat through the housing and lens to the body of water.

The underwater pendant or accent light can also provide an at least one water tight gasket or fitting, fit between the second end of the housing and the lens to render the housing water tight. The housing, the at least one water tight end fitting, the lens, and the heat sink can be generally cylindrical. The heat sink can be constructed from a thermally conductive plastic as can the housing. The heat sink can be constructed from a thermally conductive metal or composite as can the housing.

The at least one LED can be mounted on a LED printed circuit board that can be in communication with the controller in the electronics section. The at least one thermal expansion slot can be a single thermal expansion slot that is uniform along a side of the heat sink. The at least one thermal expansion slot can be non-uniform along a side of the heat sink. The thermal expansion slot can also be a single thermal expansion slot and can further comprise an at least one semi-circular portion of the thermal expansion slot permitting a further electrical coupling to pass between the electronics section and the at least one LED. The thermal expansion slot can be more than one thermal expansion slot passing through a part or the entirety of the heat sink, the heat sink sidewall, and/or the heat sink top.

The light can include additional thermal pathway structures coupling the heat sink to at least one of the at least one LED, the electronics section, and the housing. It can also include an at least one mounting device external to the housing and providing mounting of the light in the body of water.

The apparatus of the invention also includes an accent or pendant LED light submerged in a pool or spa or water feature within a return line or niche in the pool or spa or water feature, having a generally cylindrical water tight housing constructed of a thermally conductive material having a first water tight coupling at one end of the cylindrical housing, the first water tight coupling having a connection to a power source and a second water tight coupling having a lens and at least one water tight gasket at the other end of the cylindrical housing. It also has an electronics section, including a controller, a thermocouple and a first printed circuit board in electrical communication with a second printed circuit board mounting an at least one LED and controlling the at least one LED; a generally cylindrical heat sink having an at least one thermal expansion slot thereon, the heat sink having a cylindrical sidewall and a top covering one end of the sidewall and a hollow interior within the cylindrical sidewall and below the top, the at least one thermal expansion slot extending along the length of the cylindrical sidewall and through a portion of the top. Where the at least one thermal expansion slot accommodates thermal expansion of the heat sink as it absorbs heat from the electronics section and the at least one LED with the heat sink in thermal communication through a thermal path with the housing and transmitting the absorbed heat through the housing and lens to the pool or spa or water feature.

The article of manufacture of the invention includes An accent or pendant LED light submergible in a pool or spa or water feature within a return line or niche in the pool or spa or water feature, the light having a generally cylindrical water tight housing constructed of a thermally conductive material having a first water tight coupling at one end of the cylindrical housing, the first water tight coupling having a connection to a power source and a second water tight coupling having a lens and at least one water tight gasket at the other end of the cylindrical housing with an electronics section including a first printed circuit board in electrical communication with a second printed circuit board mounting an at least one LED and controlling the at least one LED; a generally cylindrical heat sink having an at least one thermal expansion slot thereon the heat sink having a cylindrical sidewall and a top covering one end of the sidewall and a hollow interior within the cylindrical sidewall and below the top, the at least one thermal expansion slot extending along the length of the cylindrical sidewall and through a portion of the top, the method comprising the steps of assembling the at least one LED to the second printed circuit board with the heat sink and the electronics section; assembling the housing with the first water tight coupling to the end of the housing and coupling the electrical source to the electronics section; assembling the housing with the second water tight coupling having a lens and an a least one water tight gasket; and operating the light.

Moreover, the above objects and advantages of the invention are illustrative, and not exhaustive, of those which can be achieved by the invention. Thus, these and other objects and advantages of the invention will be apparent from the description herein, both as embodied herein and as modified in view of any variations which will be apparent to those skilled in the art.

BRIEF DESCRIPTION OF THE DRAWINGS

Embodiments of the invention are explained in greater detail by way of the drawings, where the same reference numerals refer to the same features.

DETAILED DESCRIPTION OF THE INVENTION

Figure 1:
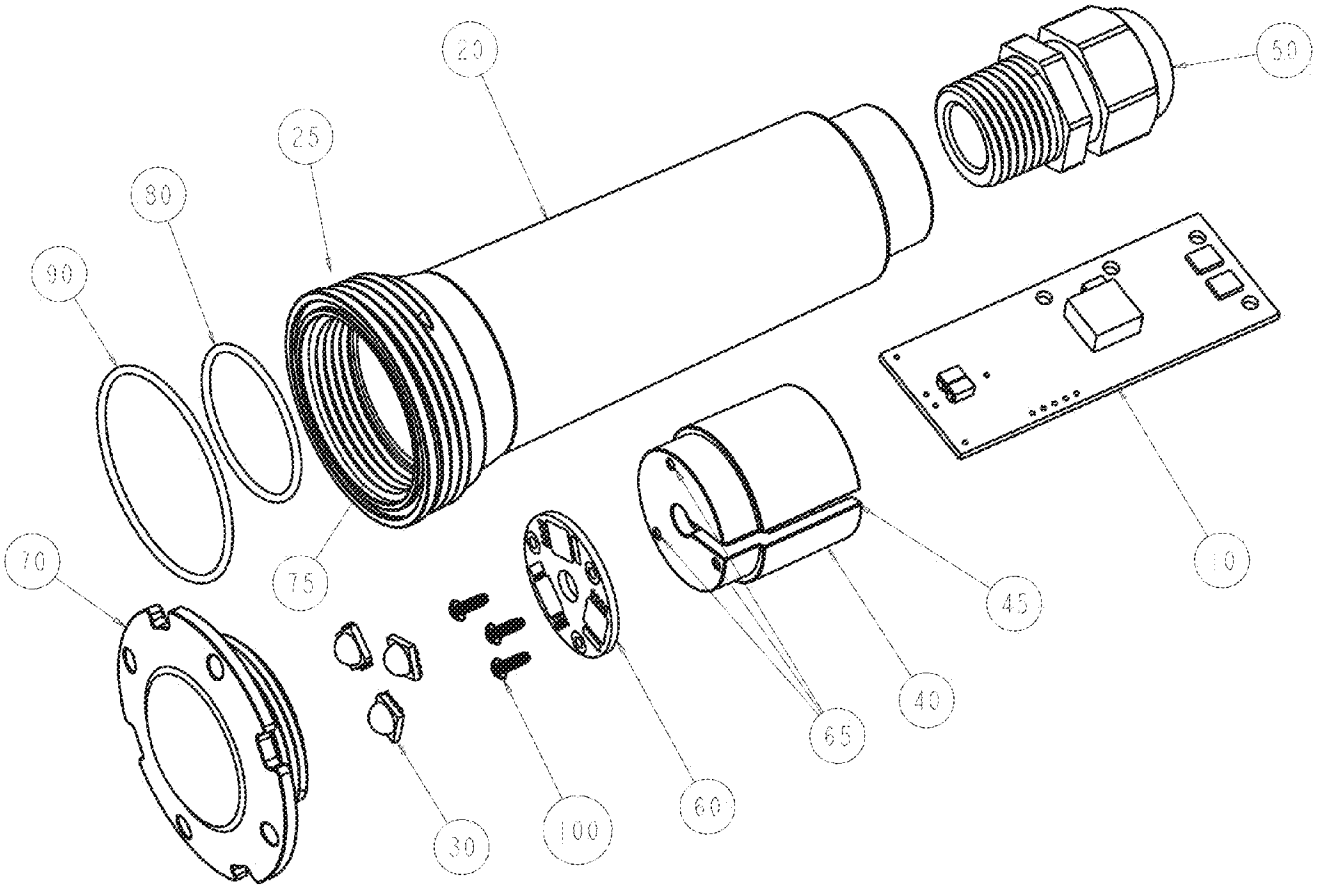
FIG. 1 is an exploded view of an exemplary embodiment of the instant invention.

FIG. 1 shows an exploded view of an exemplary embodiment of the instant invention.

The instant invention is driven by an electronics section 10, the electronics section 10 having for instance a controller on a printed circuit board located within a housing 20. The housing in this exemplary embodiment can be constructed of a thermally conductive material, such as a thermally conductive plastic or similar material that has high thermal transmissivity. The housing 20, when assembled, will be fully submerged in a body of water (not shown), including for instance but certainly not limited to a water feature, lake, pond, pool, or spa and must therefore be made water tight or water proof.

A water tight fitting 50 coupling the light to a power source (not shown) is provided at one end of the watertight housing 20. The water tight fitting 50 may also render the light self contained with a power source, such as a battery, incorporated into the light or coupled to an alternative source of power through an appropriate coupling. On the other end of the watertight housing 20 as shown, a set of optional external threads 25 are provide for mounting the light in the body of water. The external threads 25 are used with or without a mounting device (not shown) to hold the light within the body of water within the pool or water feature. Additional methods of retaining the accent light may be utilized for example, but not limited to, adhesives, wedges, or similar mechanisms or materials. A set of internal threads 75 are provided inside the housing to retain the lens 70. An at least one water tight gasket or fitting 80, 90 is placed between the screw on lens 70 and the inside threads 75. In the exemplary embodiment shown, a set of o-ring gaskets 80, 90 are provided and fit between the lens 70 and the watertight housing 20. Various types and numbers of gaskets or fittings can be utilized or the end may be a unitary construction incorporating the lens or optic without departing from the spirit of the invention to attach the lens 70 to the housing 20 and provide a water tight seal. The housing 20, is positioned in the body of water so that the lens 70 points into the body of water to provide a pleasing lighting affect. This can occur, for instance, in recesses provided in the body of water or within piping for the body of water (not shown), for instance a water return on a pool or spa or water feature.

Within the water tight housing 20 an at least one LED 30 is provided. The at least one LED 30 is potted with a thermally conductive potting material on an LED printed circuit board 60. The at least one LED 30 potted on the LED printed circuit board 60 is further potted and/or coupled, both mechanically and thermally, to a heat sink 40. The LED printed circuit board 60 can be further secured to the heat sink 40 by an at least one affixing device 100, shown in the exemplary embodiment as mounting screws 100. The mounting screws 100 fit into pre-drilled mounting points 65 in the heat sink 40. The coupling of the LED printed circuit board 60 is provided such that it can expand with the heat sink 40 as the heat sink 40 absorbs heat. A non limiting example to accommodate the expansion is to provide a further slot in the LED printed circuit board 60. Another non-limiting example is to select a printed circuit board or mounting screws that can accommodate loading and/or flexing from the expansion. Various other mechanical and non-mechanical changes can be made to accommodate the expansion and are well within the spirit of the invention.

The heat sink 40 is composed of thermally conductive material. In the exemplary embodiment of the invention shown, the heat sink 40 is constructed of, for instance but certainly not limited to, a thermally conductive metal, such as copper, brass, or aluminum, or a thermally conductive plastic in the exemplary embodiment shown. The heat sink 40 may also be comprised of a composite, a metal alloy or any suitable material with the desired thermal properties to allow for thermal loading and transmission.

Figure 2:
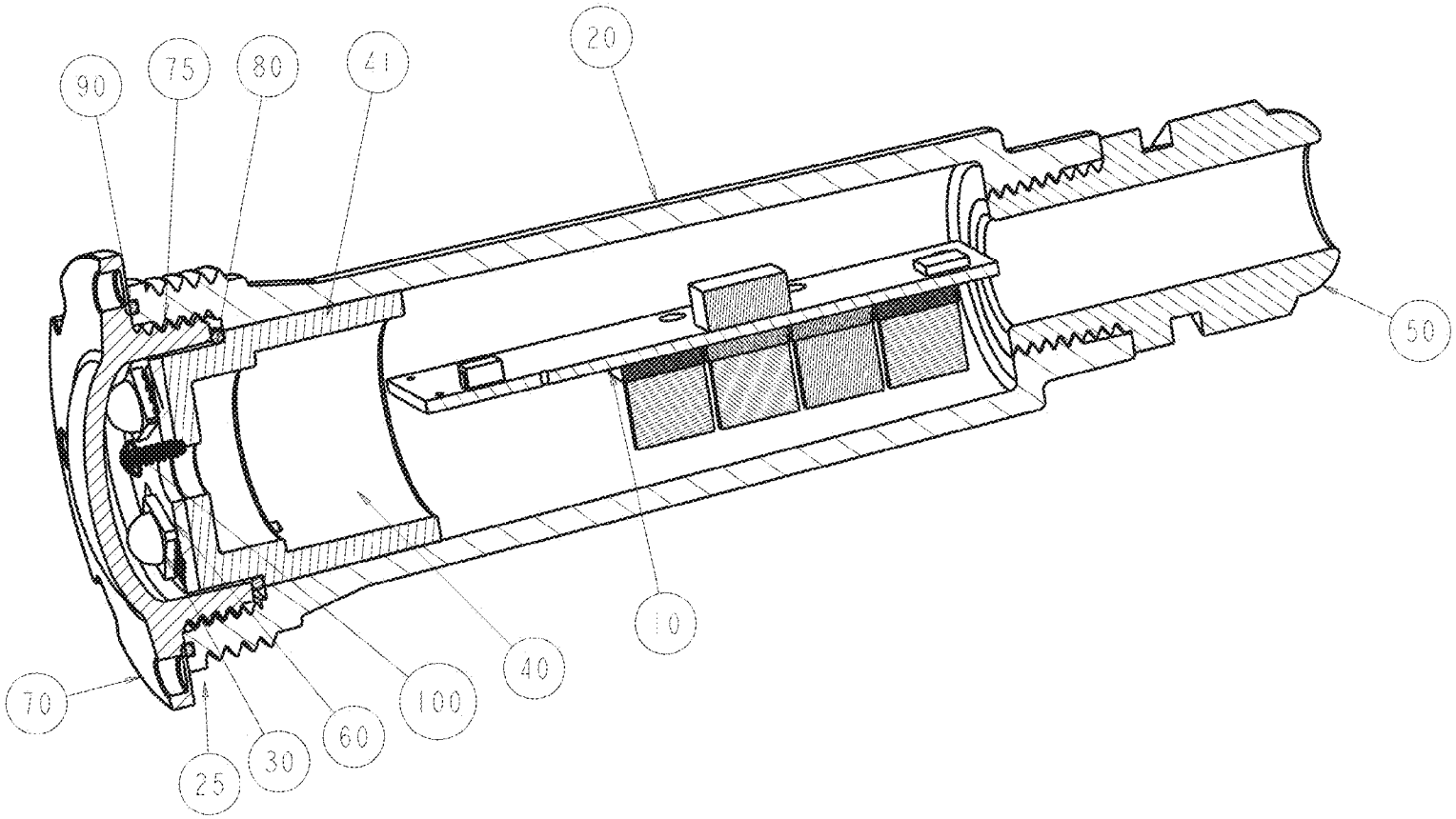
FIG. 2 is a cross sectional view along mid line of embodiment of FIG. 1.

In the exemplary embodiment shown, as better seen in FIG. 2, the heat sink 40 is placed in contact and thereby thermal communication with the housing 20. In the exemplary embodiment the heat sink 40 is potted in place with a thermal paste. This contact can be around the entirety of the heat sink 40 or around a portion of the heat sink 40. The thermally conductive material of the heat sink 40 conducts heat away from the at least one LED 30 and the electronics section 10. As the heat sink 40 is thermally coupled with the water tight housing 20 and through the water tight housing 20 to the lens 70, the heat sink 40 conducts heat into the water tight housing 20 and lens 70 and, thereby, into the water of the body of water immediately surrounding the water tight housing 20 and lens 70. This permits a greater efficiency in the cooling of the at least one LED and the electronics section 10 having the controller and electronics, especially when placed within piping or an active flow of water within the body of water. The heat sink 40 also has an at least one thermal expansion slot 45 thereon.

In the exemplary embodiment shown, the at least one thermal expansion slot is a single thermal expansion slot 45 with a uniform width throughout. In further embodiments, more than one thermal expansion slot can be provided. Similarly, in still further embodiments modifications to the width of the at least one thermal expansion slot 45 and variations in the uniformity of the at least one thermal expansion slot 45 are contemplated and well within the spirit of the invention. For instance, the at least one thermal expansion slot 45 can include semi-circular cutouts to provide for clearance of connecting wires and the like, see for instance FIG. 3A. This clearance for electrical couplings being a further benefit of the heat sink 40 having the thermal expansion slot making manufacture and assembly of the light easier and more cost efficient.

The thermal expansion slot 45 in the light provides a path for expansion as the heat sink 40 absorbs heat from the components of the light. The expansion slot 45 reduces pressure from the expansion of the heat sink 40 on the water tight housing 20. The space in the expansion slot 45 allows for the ends of the heat sink 40 to move through the thermal expansion and through the movement reduce the width of the expansion slot 45, thus reducing outward pressure on the water tight housing 20. This, in turn, results in less potential for rupture or cracking occurring in the water tight housing 20.

The heat sink 40 is thermally coupled to the LED printed circuit board 60 which is thermally coupled to the at least one LED 30. The whole arrangement is thermally coupled to the housing 20 and the lens 70, such that a thermal pathway is expediently provided for direct conductive transmission of heat from the pendant or accent light into the body of water as a heat dump. In an exemplary embodiment, a thermally transmissive compound is used to provide a thermal path for the heat through out the coupled components, for instance a thermal past or potting compound. Special thermal pathway structures, such as micro heat pipes, can also be added to provide additional thermal transmission throughout the light. The thermal path to the water surrounding the housing 20 allows for the use of higher power LEDs. Additionally, although the instant invention provides improved thermal transmission, a thermocouple limiter is provided in the electronics section 10, for instance on the printed circuit board with the controller, to prevent thermal damage if, for some reason, temperatures exceed the maximum limits of the electrical components.

The light is assembled with the water tight fitting 50 coupled to a power source (not shown) and secured to one end of the watertight housing 20 and the lens 70 is screwed into the internal threads 75 with the at least one gasket member 80, 90 with the heat sink 40, the at least one LED 30, and the LED printed circuit board 60 mounting the at least one LED. These are coupled together or held in place with a thermal compound, such as a thermally transmissive paste. The LED printed circuit board 60 is coupled to the electrical section 10 and the controller contained therein on a printed circuit board and the at least one LED 60 for controlling the at least one LED 30.

FIG. 2 is a cross sectional view along mid line of embodiment of FIG. 1. As seen in FIG. 2, the watertight housing 20 is engaged with the water tight fitting 50, here the fitting is screwed into the housing however it may be engaged in any fashion to provide a water tight connection, and the lens 70 which is threaded onto the internal threads 75 and the at least one gasket 80, 90 being engaged to provide a sound, water tight housing 20. The housing 20, the water tight fitting 50, and lens 70 with the at least one gasket 80, 90 of the exemplary embodiment shown are generally cylindrical as is the heat sink 40. Similarly, the first circuit board 60 has a substantially circular cross-section and a thickness, such that it is substantially cylindrical. The heat sink is further hollowed as shown, allowing it to expand effectively and efficiently along the thermal expansion slot 45 and permitting easier pathing of electrical connectors and more efficient assembly of the light. The specific shape can, however, be varied without departing from the spirit of the invention, provided that the at least one expansion slot 45 within the heat sink 40 can provide for reduced pressures being exerted on the housing 20 due to thermal expansion and the effective transmission of the thermal load to the water surrounding the light.

Within the housing, the at least one LED 30 is provided mounted on the at least one LED printed circuit board 60 and these are coupled to the heat sink 40. The heat sink 40 is in or nearly in communication with the housing 20. The controller and the printed circuit board in the electronics section 10 are located, in this embodiment, on the opposite side of the heat sink 40 from the at least one LED, within a hollow within the heat sink 40. The thermal expansion slot 45 is not shown clearly in this cross sectional view.

The mounting of the at least one LED 30 and the LED printed circuit board 60 in thermal communication with the heat sink 40 and the coupling of the controller and printed circuit board in the electronics section 10 in thermal communication with the heat sink 40 results in transmission of heat into the heat sink 40. The heat expands the heat sink 40, the thermal expansion slot 45 allowing for the transmission of the majority of the movement and therefore the pressure from expansion to go back into the heat sink 40, but the heat sink 40 is in or comes into communication with the housing 20 and a thermal bridge is formed with the housing 20 and the lens 70. This permits heat to transfer through the heat sink into the housing 20 and thereby into the water surrounding the light in the body of water. This results in effective cooling of the light and, with the thermal expansion slot 45 this cooling is accomplished without transmission of the majority of the pressures from thermal expansion of the heat sink 40 into the housing 20. This results in a more robust light with a longer operating life and improved soundness and less warranty claims as the expansion pressures from the thermal loading are significantly reduced, in fact almost removed.

Figure 3A:
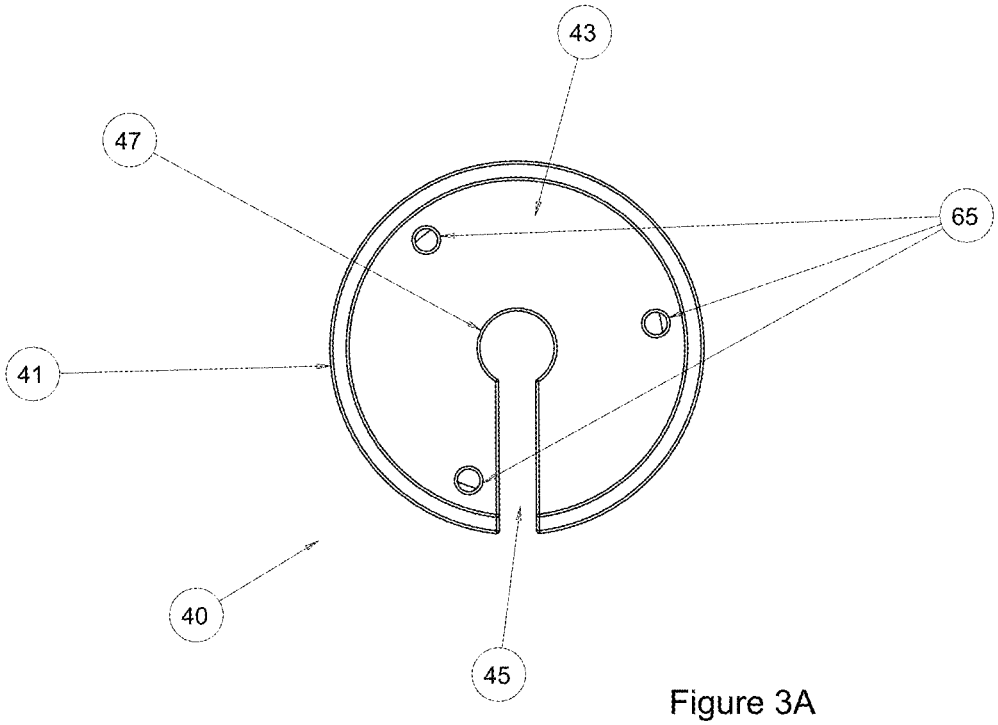
FIGS. 3A and 3B show a front view and a side view, respectively, of an exemplary embodiment of a heat sink utilized in the instant invention.
Figure 3B:
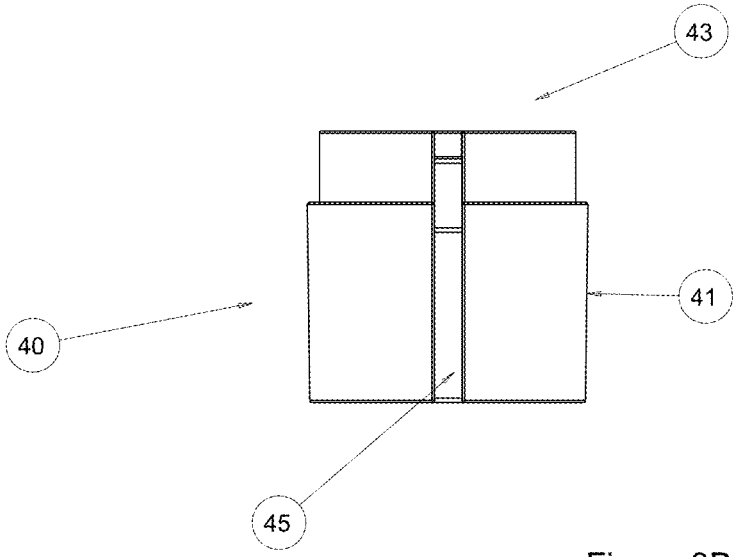

FIGS. 3A and 3B show a front view and a side view, respectively, of an exemplary embodiment of a heat sink utilized in the instant invention. FIG. 3A shows the front view of the heat sink 40 of an exemplary embodiment of the invention. The exemplary embodiment shown is a generally cylindrical heat sink 40 having an at least one thermal expansion slot 45 thereon. The heat sink 40 having a cylindrical sidewall 41 and a top 43 with a hollow interior within the cylindrical sidewall 41 and below the top 43. The at least one thermal expansion slot 45 extending along the length of the cylindrical sidewall 41, as best seen in FIG. 3B, and through a portion of the top 43 as shown in FIG. 3A. The exemplary embodiment provides for mounting points 65 for the LED printed circuit board 60, the at least one thermal expansion slot 45 and, in the embodiment shown, a circular portion of the thermal expansion slot 47. The circular portion 47 on the front or top 43 of the heat sink 40 provides a path for wiring from the controller in the electronics section 10 to the LED printed circuit board 60 when the light is assembled. The remainder of the thermal expansion slot 45 is uniform through the front or top 43 of the heat sink 40.

FIG. 3B shows the side view of the heat sink 40 of an exemplary embodiment. The thermal expansion slot 45 is clearly shown, being uniform along the length of the side of the heat sink 40 in the exemplary embodiment shown. As noted with respect to FIG. 3A, additional portions of the thermal expansion slot may have variations in the shape and structure of the thermal expansion slot 45 without departing form the spirit of the invention. Additionally, the heat sink 40 can be uniform or non-uniform in shape, for instance in the exemplary embodiment shown the generally cylindrical heat sink 40 is varied in diameter.

The embodiments and examples discussed herein are non-limiting examples. The invention is described in detail with respect to exemplary embodiments, and it will now be apparent from the foregoing to those skilled in the art that changes and modifications may be made without departing from the invention in its broader aspects, and the invention, therefore, as defined in the claims is intended to cover all such changes and modifications as fall within the true spirit of the invention.

What is claimed is:

1. An underwater light for use in a body of water, the underwater light comprising:

a cylindrical housing including a first end having internal threads, the housing being watertight and submersible in the body of water;

a lens including a cylindrical extension having external threads configured to engage the internal threads of the first end of the housing;

a first circuit board having a substantially circular shape positioned inside the cylindrical housing;

at least one light emitting diode coupled to the first circuit board;

a second circuit board having a substantially rectangular shape positioned inside the housing perpendicular to the first circuit board;

a controller coupled to the second circuit board and electrically connected to the first circuit board with wiring in order to drive the at least one light emitting diode; and a heat sink coupled to the first circuit board, the heat sink having a thin-walled, substantially cylindrical sidewall and a substantially circular top that define a hollow region extending to a bottom of the heat sink, the hollow region having a radial width larger than a width of the sidewall, the first circuit board coupled to the substantially circular top, the substantially circular top including a circular opening and a thermal expansion slot into the hollow region, the thermal expansion slot extending from the circular opening radially through the substantially circular top and axially along and through the cylindrical sidewall, the wiring from the second circuit board to the first circuit board passing through the circular opening and the hollow region, the thermal expansion slot reducing pressure exerted on the cylindrical housing due to thermal expansion of the heat sink caused by heat emitted by the at least one light emitting diode, and a portion of the heat sink positioned inside of the cylindrical extension of the lens when the external threads of the cylindrical extension are engaged with the internal threads of the first end of the housing.

2. The underwater light of claim 1, further comprising at least one gasket positioned between the lens and the first end of the cylindrical housing.

3. The underwater light of claim 1, and further comprising a watertight fitting coupled to a second end of the cylindrical housing and to a power source.

4. The underwater light of claim 1, wherein the heat sink is constructed from at least one of a thermally conductive plastic, metal, and composite.

5. The underwater light of claim 1, wherein the cylindrical housing is constructed from at least one of a thermally conductive plastic, metal, and composite.

6. The underwater light of claim 1, wherein the thermal expansion slot has a uniform width axially along the cylindrical sidewall of the heat sink.

7. The underwater light of claim 1, wherein the second circuit board includes a thermocouple limiter.

8. The underwater light of claim 1, wherein the heat sink is open at the bottom.

9. An underwater light for use in a body of water, the underwater light comprising:

a housing including a first end having internal threads, the housing being watertight and submersible in the body of water;

a lens including a cylindrical extension having external threads configured to engage the internal threads of the first end of the housing;

a first circuit board positioned inside the housing;

at least one light emitting diode coupled to the first circuit board;

a second circuit board positioned inside the housing;

a controller configured to drive the at least one light emitting diode; and a heat sink coupled to the first circuit board, the heat sink having a top and a thin-walled sidewall that define a hollow region extending to a bottom of the heat sink and having a radial width larger than a width of the sidewall, a first portion adjacent the top of the heat sink having a smaller outer diameter than a second portion adjacent the bottom of the heat sink, the top including an opening and a thermal expansion slot into the hollow region, the thermal expansion slot extending from the opening radially through the top and axially along and through the sidewall, and the first portion of the heat sink positioned within the cylindrical extension of the lens when the external threads of the cylindrical extension are engaged with the internal threads of the first end of the housing.

10. The underwater light of claim 9, wherein at least one of the housing and the heat sink are cylindrical.

11. The underwater light of claim 9, wherein the first circuit board has a substantially cylindrical shape.

12. The underwater light of claim 9, wherein the second circuit board has a substantially rectangular shape.

13. The underwater light of claim 9, wherein the first circuit board is positioned perpendicular to the second circuit board.

14. The underwater light of claim 9, wherein the controller is coupled to the second circuit board.

15. The underwater light of claim 9, wherein the controller is electrically connected to the first circuit board with wires.

16. The underwater light of claim 9, wherein the first circuit board is coupled to the top of the heat sink.

17. The underwater light of claim 9, wherein wiring from the second circuit board to the first circuit board passes through the opening and the hollow region.

18. The underwater light of claim 9, wherein the thermal expansion slot reduces pressure exerted on the housing due to thermal expansion of the heat sink caused by heat emitted by the at least one light emitting diode.

19. The underwater light of claim 9, wherein the heat sink is open at the bottom.

* * * * *